US008863902B2

(12) United States Patent
Lanzafame

(10) Patent No.: US 8,863,902 B2
(45) Date of Patent: Oct. 21, 2014

(54) LADDER ACCESSORY QUICK-MOUNTING BASE WITH GUIDE LIPS

(76) Inventor: Philip F. Lanzafame, Poulsbo, WA (US)

( * ) Notice: Subject to any disclaimer, the term of this patent is extended or adjusted under 35 U.S.C. 154(b) by 0 days.

(21) Appl. No.: 12/462,151

(22) Filed: Jul. 30, 2009

(65) Prior Publication Data

US 2011/0232999 A1 Sep. 29, 2011

Related U.S. Application Data

(63) Continuation-in-part of application No. 10/697,674, filed on Oct. 29, 2003, now Pat. No. 7,036,633, and a continuation-in-part of application No. 11/142,080, filed on May 31, 2005, now abandoned.

(51) Int. Cl.

| | |
|---|---|
| ***E06C 7/14*** | (2006.01) |
| ***E06C 7/16*** | (2006.01) |
| ***E06C 1/34*** | (2006.01) |
| ***E06C 7/18*** | (2006.01) |
| ***E06C 1/397*** | (2006.01) |
| ***E06C 7/44*** | (2006.01) |

(52) U.S. Cl.

CPC ... *E06C 1/34* (2013.01); *E06C 7/16* (2013.01); *E06C 7/183* (2013.01); *E06C 1/397* (2013.01); *E06C 7/44* (2013.01); *E06C 7/14* (2013.01)

USPC ..... 182/129

(58) Field of Classification Search

USPC ..... 182/129

See application file for complete search history.

(56) References Cited

U.S. PATENT DOCUMENTS

| | | | |
|---|---|---|---|
| 63,468 | A | 4/1867 | Card |
| 769,419 | A | 9/1904 | Wagner |
| 783,259 | A | 2/1905 | Friend |
| 891,729 | A | 6/1908 | Phipps |
| 970,425 | A | 9/1910 | Curran |
| 971,997 | A | 12/1910 | Brasington |
| 979,821 | A | 12/1910 | Brasington |
| 1,033,685 | A | 7/1912 | Eskew |
| 1,236,269 | A | 8/1917 | Cole |
| 1,251,192 | A | 12/1917 | Drummond |
| 1,265,636 | A | 5/1918 | Farnsworth |
| 1,280,741 | A | 10/1918 | Hunn |
| 1,329,740 | A | 2/1920 | Barron |
| 1,376,777 | A | 5/1921 | O'Connor |
| 1,393,536 | A | 10/1921 | Hunt |
| 1,419,748 | A | 6/1922 | Miller |
| 1,462,505 | A | 7/1922 | Hunt |
| 1,508,392 | A | 6/1924 | Heun |
| 1,223,367 | A | 11/1925 | Crump |
| 1,560,978 | A | 11/1925 | Crump |
| 1,733,338 | A | 10/1929 | Enke |
| 1,887,495 | A | 11/1932 | Carter |
| 1,862,171 | A | 6/1937 | Baker |
| 2,147,052 | A | 2/1939 | Nonne |
| 2,152,895 | A | 4/1939 | Longtin |
| 2,245,306 | A | 6/1941 | Smith |
| 2,331,629 | A | 10/1943 | Reilly |

(Continued)

*Primary Examiner* — Alvin Chin-Shue

(74) *Attorney, Agent, or Firm* — Jeffrey T. Haley

(57) ABSTRACT

Designs for adapting a ladder rail so that accessories to the ladder can be quickly and securely mounted and released without using tools. Aspects of the invention include attachment bases permanently mounted to the ladder rail with structures for toolless attachment and release of accessories to the base, including guide lips that allow the accessory to be easily removed.

10 Claims, 9 Drawing Sheets

(56) References Cited

U.S. PATENT DOCUMENTS

| | | | | | |
|---|---|---|---|---|---|
| 2,350,166 | A | | 5/1944 | Kimes | |
| 2,405,269 | A | | 8/1946 | Prutsman | |
| 2,449,609 | A | | 9/1948 | Linder et al. | |
| 2,458,076 | A | | 1/1949 | Houston | |
| 2,517,771 | A | | 8/1950 | Stefanoy | |
| 2,552,941 | A | | 5/1951 | Courtne | |
| 2,598,875 | A | | 6/1952 | Anderson | |
| 2,608,336 | A | | 8/1952 | Dole | |
| 2,936,849 | A | | 5/1960 | Larson | |
| 2,945,713 | A | | 7/1960 | Sears | |
| 3,016,103 | A | | 1/1962 | Studer | |
| 3,047,061 | A | | 7/1962 | Wilcox et al. | |
| 3,165,170 | A | | 1/1965 | Blaney | |
| 3,170,708 | A | | 2/1965 | Miller | |
| 3,173,512 | A | | 3/1965 | Sturdy et al. | |
| 3,179,206 | A | | 4/1965 | Studer | |
| 3,233,702 | A | | 2/1966 | Lent | |
| 3,233,703 | A | | 2/1966 | Feltrop | |
| 3,259,209 | A | * | 7/1966 | Brown | 182/189 |
| 3,406,785 | A | | 10/1968 | Pilcher | |
| 3,484,814 | A | | 12/1969 | Meehan | |
| 3,527,321 | A | | 9/1970 | Brown | |
| 3,554,321 | A | | 1/1971 | Steadman | |
| 3,882,966 | A | | 5/1975 | Fasano | |
| 3,908,796 | A | | 9/1975 | Hurwitz | |
| 3,948,352 | A | | 4/1976 | Larson et al. | |
| 3,973,860 | A | | 8/1976 | Kern | |
| 4,014,406 | A | | 3/1977 | Easton | |
| 4,085,820 | A | | 4/1978 | Cerny | |
| 4,095,671 | A | | 6/1978 | Forristall et al. | |
| 4,147,231 | A | | 4/1979 | Chantler | |
| 4,249,638 | A | | 2/1981 | Fernandez | |
| 4,323,226 | A | * | 4/1982 | Close | 269/208 |
| 4,423,797 | A | | 1/1984 | Batten | |
| 4,606,432 | A | | 8/1986 | Belt | |
| 4,607,726 | A | | 8/1986 | Davis | |
| 4,683,980 | A | | 8/1987 | Vayko | |
| 4,744,441 | A | | 5/1988 | Sandstrom | |
| 4,766,976 | A | | 8/1988 | Wallick | |
| 4,802,471 | A | | 2/1989 | Cordell | |
| 4,807,720 | A | | 2/1989 | Kim | |
| 4,984,655 | A | | 1/1991 | Scheprer et al. | |
| 4,995,474 | A | | 2/1991 | Gauthier | |
| 5,027,923 | A | | 7/1991 | Derome | |
| 5,044,468 | A | | 9/1991 | Worthington | |
| 5,148,892 | A | | 9/1992 | Lu | |
| 5,174,412 | A | | 12/1992 | Vega | |
| 5,222,575 | A | | 6/1993 | Santos | |
| 5,228,535 | A | * | 7/1993 | McCarty | 182/163 |
| 5,273,133 | A | | 12/1993 | Thocher et al. | |
| 5,307,900 | A | | 5/1994 | Noga | |
| 5,325,936 | A | | 7/1994 | Baker | |
| 5,341,899 | A | | 8/1994 | Casamento | |
| 5,423,510 | A | * | 6/1995 | Almoslino | 248/345.1 |
| 5,464,071 | A | | 11/1995 | Rice | |
| 5,476,153 | A | | 12/1995 | Dickerson et al. | |
| 5,497,850 | A | | 3/1996 | Patterson | |
| 5,507,364 | A | | 4/1996 | Spevak | |
| 5,526,898 | A | | 6/1996 | Clark | |
| 5,542,497 | A | | 8/1996 | Macyszyn | |
| 5,551,529 | A | | 9/1996 | Molitor | |
| 5,553,963 | A | | 9/1996 | Hoy | |
| 5,609,222 | A | | 3/1997 | Horbacewicz | |
| 5,669,462 | A | | 9/1997 | Jennings | |
| 5,678,656 | A | | 10/1997 | Lanzafame | |
| 5,695,164 | A | | 12/1997 | Hartman et al. | |
| 5,718,306 | A | | 2/1998 | Baker | |
| 5,755,307 | A | | 5/1998 | Dunnewin et al. | |
| 5,771,992 | A | | 6/1998 | Snyder | |
| 5,791,438 | A | | 8/1998 | Kempton | |
| 5,816,364 | A | | 10/1998 | Christy et al. | |
| 5,845,744 | A | | 12/1998 | Beck et al. | |
| 5,853,065 | A | | 12/1998 | Hutson et al. | |
| 6,234,273 | B1 | | 5/2001 | Moore | |
| 6,349,907 | B1 | | 2/2002 | Hollington | |
| 6,374,947 | B1 | | 4/2002 | Nurkiowicz | |
| D457,650 | S | | 5/2002 | MacDuff | |
| 6,401,866 | B1 | | 6/2002 | Roy | |
| 6,408,984 | B1 | | 6/2002 | Cavagnaro | |
| 6,435,306 | B2 | | 8/2002 | Stoneburg | |
| 6,450,292 | B1 | | 9/2002 | Sheffield | |
| 6,595,326 | B1 | | 7/2003 | Dean | |
| D479,339 | S | | 9/2003 | McDonald | |
| 6,708,993 | B2 | | 3/2004 | Feik | |
| 2002/0117821 | A1 | | 8/2002 | Abraham | |
| 2003/0122333 | A1 | | 7/2003 | Abraham | |
| 2003/0230452 | A1 | * | 12/2003 | Campagna et al. | 182/129 |
| 2004/0129497 | A1 | | 7/2004 | Weiss | |
| 2007/0163839 | A1 | * | 7/2007 | Dangrow et al. | 182/204 |

* cited by examiner

FIG. 11
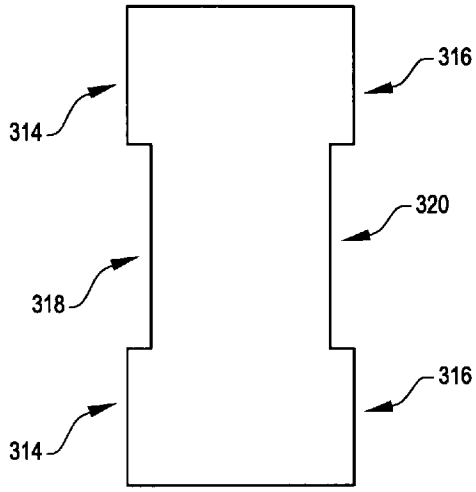
FIG. 12
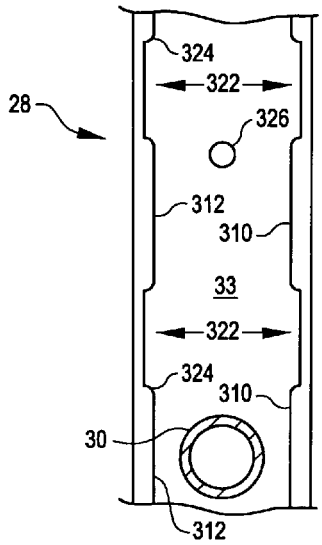
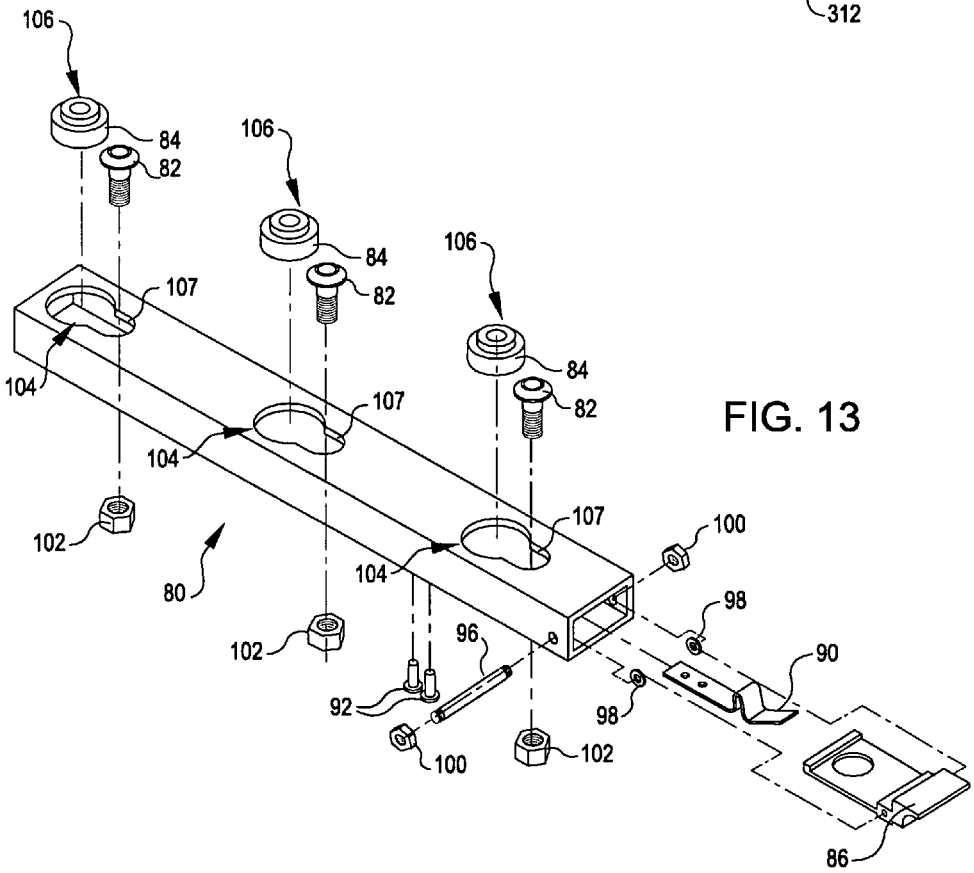
FIG. 13

LADDER ACCESSORY QUICK-MOUNTING BASE WITH GUIDE LIPS

CROSS-REFERENCE TO RELATED APPLICATIONS

The present application is a continuation-in-part of U.S. patent application Ser. No. 10/697,674 filed 29 Oct. 2003 entitled QUICK RELEASE FOR LADDER LEVELERS now U.S. Pat. No. 7,036,633 which claims priority from U.S. provisional patent applications, Nos. 60/549,195 and 60/577,048, respectively filed 1 Mar. 2004 and 3 Jun. 2004; and is a continuation-in-part of U.S. patent application Ser. No. 11/142,080 filed May 31 2005 now abandoned entitled ACCESSORY ATTACHMENT SYSTEM FOR A LADDER, AND METHODS; and claims priority from U.S. provisional patent applications 61/137,506 filed Jul. 30, 2008 and 61/217,491 filed Jun. 2, 2009.

BACKGROUND

Extension ladders, combination ladders, and stepladders consist essentially of two rails with rungs between the rails. Various accessories, for example levelers, wheels, tool or paint can hooks and plank support brackets, can be attached to the ladders to help one work from the ladder. Each of these accessories typically has its own method of attachment to the ladder, for example releasably hooking onto the rungs or securely held to the rails by bolts placed through holes specially drilled into the rails and threaded into a nut or receptacle of the accessory.

For example, for many types of ladders it is useful to have a leveler at the bottom of one leg or both legs. The leveler effectively adjusts the length of the bottom of the leg so that the ladder will go straight up from uneven ground or from different treads in a staircase. For safety, levelers are preferably securely bolted to the rails of the ladder or a static portion of the leveler may be integral with the leg of the ladder.

For ladders that are often used without an accessory, it is undesirable to have the extra weight of the accessory always present. Although accessories have been designed that quickly attach to rungs of a ladder or slip over the bottoms of the rails to achieve a quick attachment and release feature, these attachments are not sufficiently secure and include protrusions that catch on objects, damaging the object or the protrusion or creating a hazard.

SUMMARY OF THE INVENTION

The invention is a way of adapting a ladder rail so that accessories to the ladder can be quickly and securely mounted and released without using tools. Aspects of the invention include: (1) novel configurations of holes in ladder rails for receiving accessories for toolless attachment and release; (2) novel catches affixed to the rail to secure the accessory; (3) novel attachment bases permanently mounted to the ladder rail with structures for toolless attachment and release of accessories to the base; (4) novel catches affixed to the base to secure the accessory; (5) novel attachment structures on the accessory for toolless attachment and release of the accessory to a base or a ladder rail; and (6) novel catches affixed to the accessory to secure the accessory to a base or rail.

In one aspect of the invention, a ladder includes a rail, the rail being essentially an I-beam with a web connecting the beam portion that is most in compression with the beam portion that is most in tension. The web may be adapted so that the accessory can be placed in contact with the web and then slid along guides that restrict movement, or pivoted around one or more engaging hooks that restrict movement, until it seats in engagement with the web whereupon a catch secures the accessory. The adaptation may be directly in the web or in an attachment base affixed to the web.

The guides along which the accessory may be slid may be slots cut into the web or base or channels formed by adding material to an outer surface of the web or base, in which case insertion gaps may cut into outer walls of the channels to allow flanges or tabs of the accessory to be inserted into the channels.

The catch may be affixed to the ladder or attachment base or it may be affixed to accessory. If affixed to the accessory, it may be a spring loaded latch on the accessory that catches a hole in the web or base or other surface of the ladder that is generally perpendicular to the direction of movement of the accessory that would allow release of the accessory. If affixed to the ladder, it may be affixed to an outer surface of the web or to an inner surface or to a rung. If affixed to an inner surface of the web or to the base, it may act on a pin of the accessory inserted through a hole in the web or base. To retain the accessory, the catch may prevent the pin (such as a knob or an L-hook) from moving parallel to the surface of the web or base or it may prevent the pin from being retracted out of the hole, such as by fitting into a recess in a side of the pin, which recess might be a hole through the pin.

BRIEF DESCRIPTION OF THE DRAWINGS

The features of the present invention which are believed to be novel are set forth with particularity in the appended claims. Aspects of the invention may best be understood by making reference to the following description taken in conjunction with the accompanying drawings wherein:

FIG. 11 is a side view of an accessory attachment plate that fits into the channels formed by added flanges.

FIG. 12 is side view of the ladder rail with added flanges and cut outs in the flanges.

FIG. 13 shows the quick attachment components built into base unit that may be permanently bolted to a ladder rail so that quick attachment holes do not need to be cut into the ladder and it shows a catch in the form of a spring loaded latch.

DETAILED DESCRIPTION

In the following detailed description of exemplary embodiments of the invention, reference is made to the accompanying drawings. The detailed description and the drawings illustrate specific exemplary embodiments by which the invention may be practiced. Other embodiments may be utilized, and other changes may be made, without departing from the spirit or scope of the present invention. The following detailed description is therefore not to be taken in a limiting sense, and the scope of the present invention is defined by the stated claims.

Keyhole Slots

Figure 1:
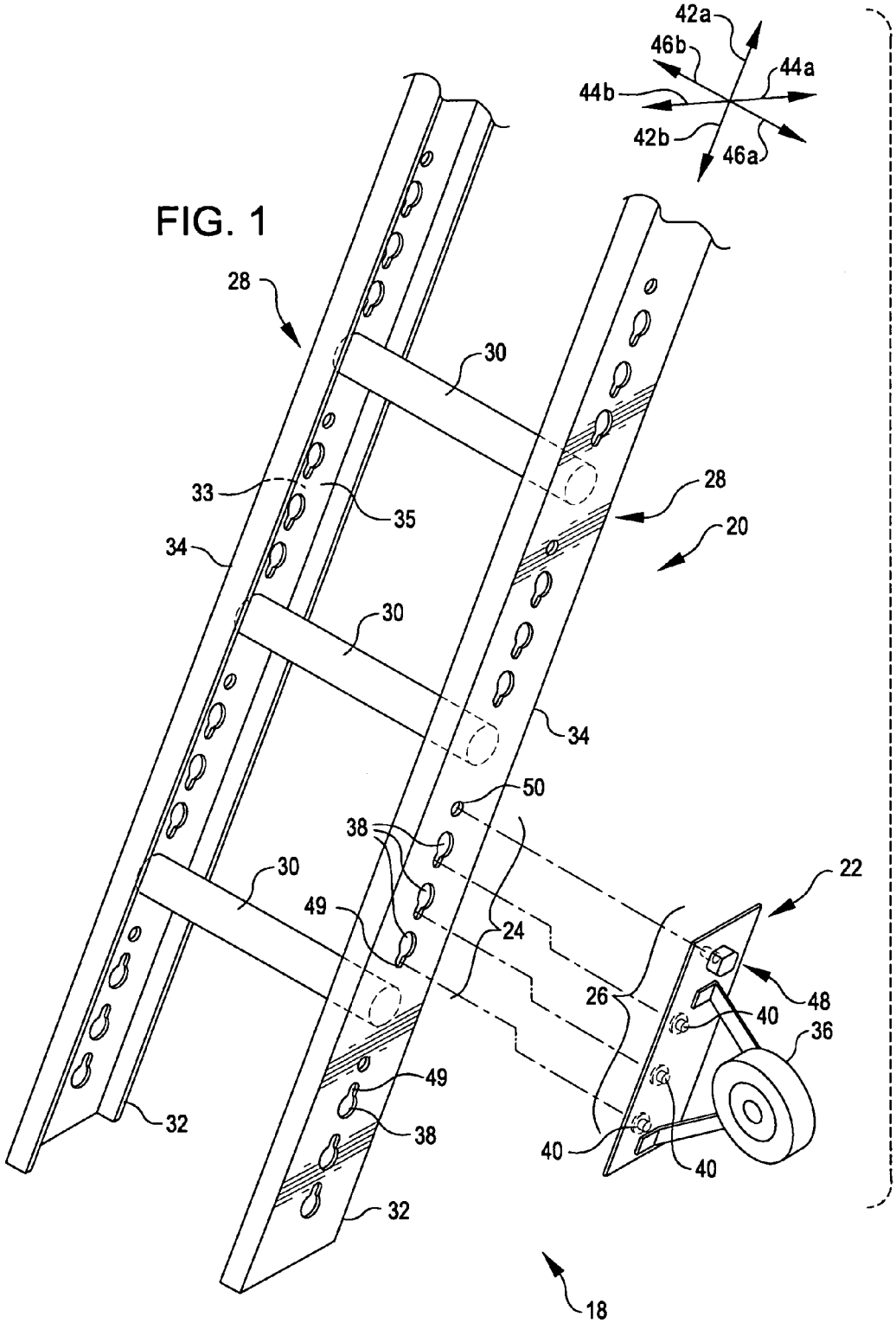
FIG. 1 is an exploded, perspective view of a ladder system that incorporates a ladder accessory releasably attachable to keyhole shaped slots in a ladder rail.

FIG. 1 is an exploded, perspective view of a ladder system 18 according to an embodiment of the invention. The ladder system 18 includes a ladder 20 and a ladder accessory 22 releasably mounted to the ladder 20. The ladder 20 includes a ladder-accessory mount 24 (eight shown but only one indicated with the reference number 24 for clarity), and the ladder accessory 22 includes a ladder mount 26 (a portion of the accessory) that one can couple to the ladder-accessory mount 24 to releasably attach the ladder accessory 22 to the ladder 20. The ladder 20 also includes two rails 28 which are comprised of beams with a web connecting the structural elements that experience the most tension and compression. The web in each rail has an outer surface 33 and an inner surface 35. Rungs 30 are disposed between the webs and attached at the inner web surfaces 35. Each rail 28 includes an end 32.

Figure 14:
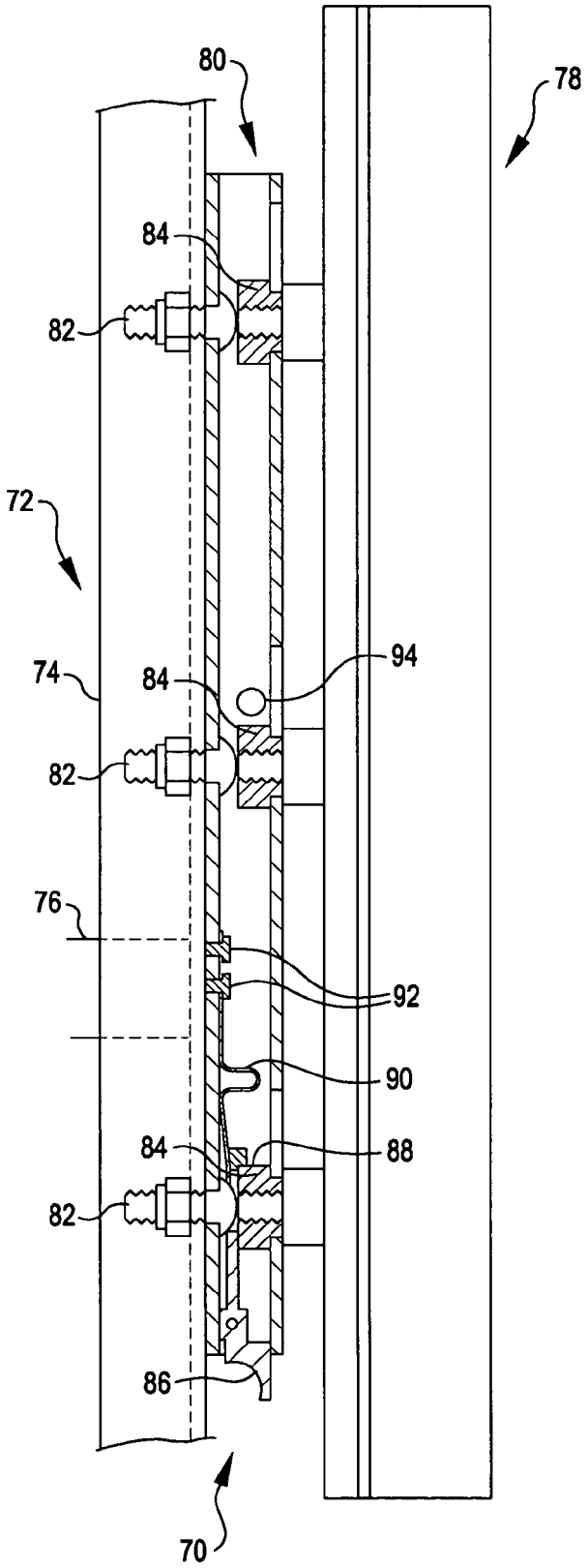
FIG. 14 shows the base unit bolted to a ladder and an accessory quick-connected to the base unit.

As shown in FIG. 1, each rail 28 may incorporate one or more ladder-accessory mounts 24 as desired. Each accessory mount may be made simply by placing holes in a defined pattern in the web or by affixing an accessory mounting base, as shown in FIGS. 13 and 14, which has attachment structures. Each mount may comprise a set of slots or holes or opposing channels as further explained below. A particular accessory may use all holes or slots or channels in a single mount or it may use less than all or it may use part of one mount an part of another mount. The slots or holes or channels may be disposed on the outer surface of the web of each rail in such a way that they are continuously and evenly spaced along the entire web and the web is all one very long mount, only a small part of which is used by any one accessory.

Figure 3:
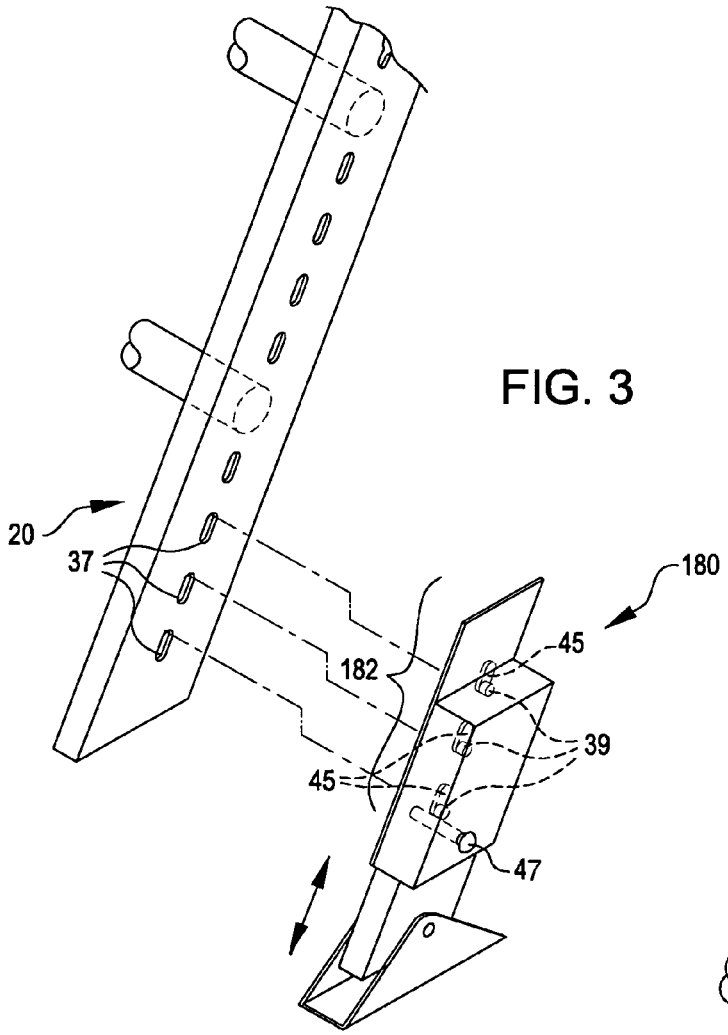
FIG. 3 is an exploded, perspective view of a ladder system that incorporates a ladder accessory with L-hooks releasably attachable to oval shaped slots in a ladder rail.
Figure 7:
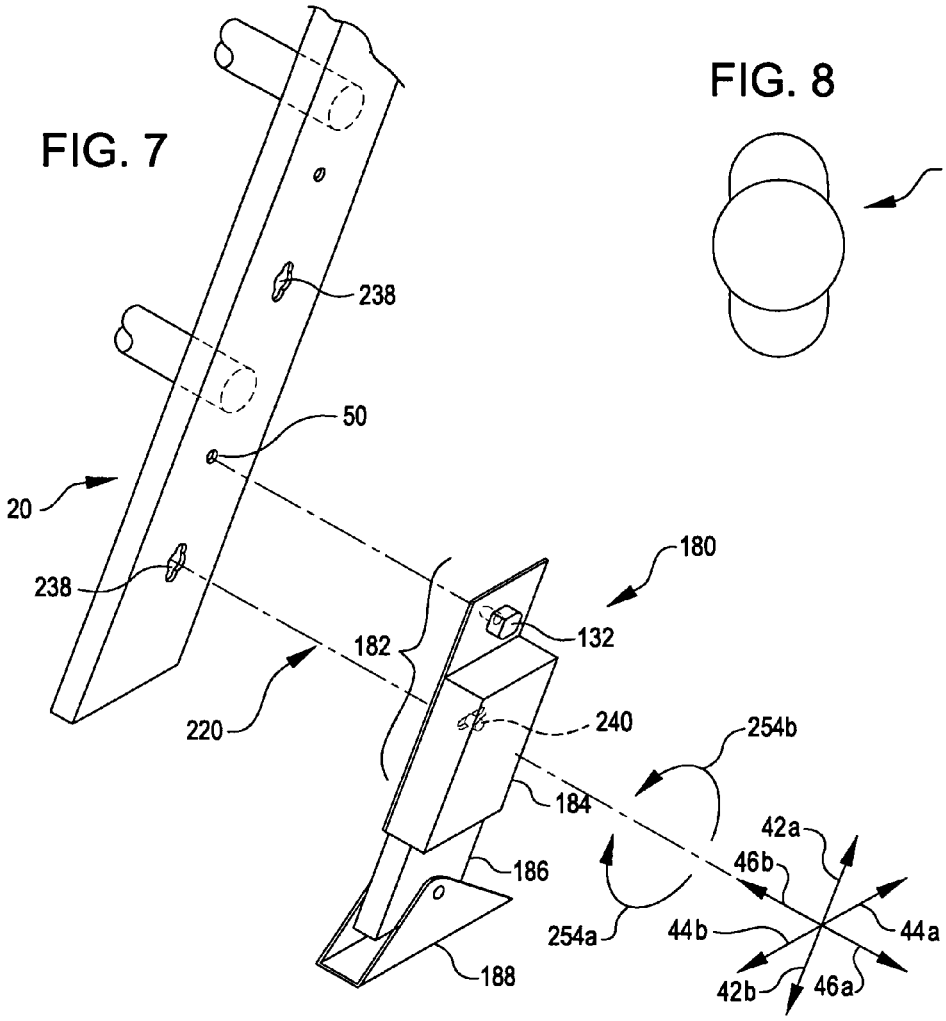
FIG. 7 shows a rail with a butterfly hole in the web configured for accessories to be locked to the rail by rotation into engagement.
Figure 8:
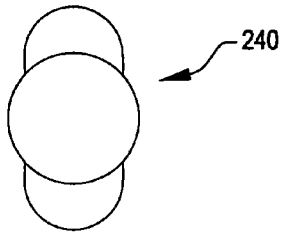
FIG. 8 shows a butterfly knob for insertion into the butterfly hole.

Examples of accessories that may be attached include a wheel 36 for ease of transporting the ladder, shown in FIG. 1, a ladder platform, a ladder jack, a V-rung and hook, a safety cinch strap, a carriage and ski, a hook, a standout bracket, a stabilizer, and a leveler (shown in FIGS. 3 and 7).

The ladder-accessory mount 24 may comprise any combination of slots, holes, or opposing channels that that can be used by pins or knobs or hooks or flanges of a ladder-mount 26 portion of an accessory 22 to cooperate with each other to releasably attach the ladder accessory 22 to the ladder 20. For example, as shown in FIG. 1, the ladder-accessory mount 24 may include three keyhole slots 38, and the ladder mount 26 may include three knob protrusions 40 that mate with a respective one of the slots 38 to restrain movement of the ladder accessory 22 relative to the rail 28 in five of six directions 42*a*, 42*b*, 44*a*, 44*b*, 46*a* and 46*b*, The direction 42*a* is up along the rail 28, and the direction 42*b* is opposite the direction 42*a* or down along the rail 28. The direction 44*a* is perpendicular to the directions 42*a* and 42*b*, and right, along the width of the rail 28, and the direction 44*b* is opposite the direction 42*a* or left along the width of the rail 28. The direction 46*a* is perpendicular to the directions 42*a*, 42*b*, 44*a* and 44*b*, and out away from the rungs 30 of the ladder 20, and the direction 46*b* is opposite the direction 46*a* or toward the rungs 30 of the ladder 20.

Still referring to FIG. 1, the outer web surface 33 or outer mounting base surface may include a catchment surface which in FIG. 1 is a hole 50 which is acted against by a catch or latch on the accessory to secure the ladder accessory 22 to the outer web surface 33. For example, in one embodiment the ladder mount 26 of the ladder accessory 22 includes the spring latch 48. The spring latch 48 includes a locking pin (not identified with a reference numeral) that may be inserted into the hole 50 in the rail 28. The spring latch 48 restrains movement of the ladder accessory 22 relative to the rail 28 in the sixth direction (here direction 42*a* or up) when the ladder accessory 22 is releasably attached to the rail 28. Thus, the spring latch 48 secures the ladder accessory 22 to the ladder 20. In applications when the weight of the ladder accessory 22 or the pressure exerted on the accessory 22 from a tool, material or user supported by the accessory 22 sufficiently restrains the accessory from moving relative to the rail 28 in the sixth direction 42*a*, the spring latch 48 may be omitted or not used. However, when the spring latch 48 is used in such applications, the spring latch provides additional security against the ladder accessory being accidentally released from the ladder 20.

In operation, one releasably attaches the ladder accessory 22 to the ladder 20 by coupling the ladder mount 26 portion of the accessory 22 with the ladder-accessory mount 24 on the ladder rail or mounting base. For example, in one embodiment one inserts each protrusion 40 into a respective one of the slots 38. Then one moves each protrusion up or in the direction 42*a*, or down or in the direction 42*b* (here down) inside the slot 38 to insert each protrusion 40 into the narrower portion 49 of the respective keyhole slot 38. Contact between one or more of the protrusions 40 with the narrower portion 49 of respective keyhole slots 38 restrain movement of the ladder accessory 22 relative to the rail 28 in the directions 42*b*, 44*a*, 44*b*, 46*a* and 46*b*, With each protrusion 40 inserted in the narrower portion 49 of the respective slot 38, the locking pin of the spring latch 48 is aligned with hole 50 and urged into the hole. To remove the ladder accessory 22 to replace it with another one, one removes the accessory 22 by withdrawing the locking pin from the hole 50, moving the protrusions 40 up or in the direction 42*a* relative to the rail 28, and withdrawing each protrusion 40 from the respective slot 38. The latch 48 in FIG. 1 may be withdrawn from the hole 50 by pulling on the base of the pin from the accessory side or by pushing on the head of the pin from inside the ladder rail.

Figure 2:
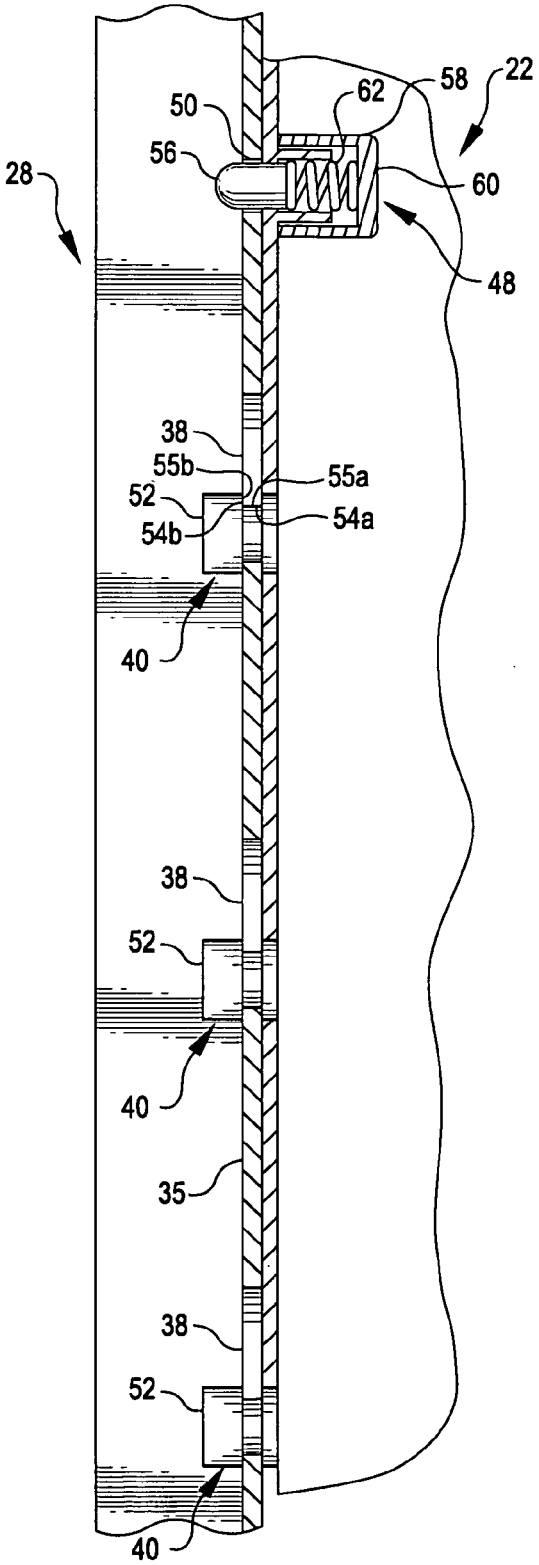
FIG. 2 is a cross-sectional view of the ladder accessory in FIG. 1 releasably attached to the ladder.

FIG. 2 is a cross-sectional view of the ladder accessory 22 releasably attached to the ladder 20.

Each protrusion 40 and slot 38 may be configured as desired to restrain movement of the ladder accessory 22 relative to the ladder rail 28 when a protrusion 40 is inserted into a respective one of the keyhole slots 38. For example, in one embodiment each protrusion includes a knob 52 and each slot 38 includes a narrower portion 49 (FIG. 1). The knob 52 includes contact surfaces 54*a* and 54*b*, and each slot includes contact surfaces 55*a* and 55*b*, When a protrusion 40 is inserted into the narrower portion 49 of a respective slot 38 and pressure is exerted on the ladder accessory 22 in one or more of the directions 42*b*, 44*a* and 44*b*, the contact surfaces 54*a* and 55*a* contact each other to restrain movement of the ladder accessory 22 relative to the rail 28. And when pressure is exerted on the ladder accessory 22 in the direction 46*a*, the contact surfaces 54*b* and 55*b* contact each other to restrain movement of the ladder accessory 22 relative to the rail 28. Movement of the ladder accessory 22 relative to the rail 28 in the direction 46*b* is restrained by contact between the rail 28 and the ladder accessory 22. Movement of the ladder accessory 22 relative to the rail 28 in the direction 42*a* is restrained by the spring latch 48.

Still referring to FIG. 2, the spring latch 48 may automatically lock the ladder accessory 22 to the ladder 20, when the ladder-accessory mount 24 is coupled to the ladder mount 26. For example, in one embodiment the spring latch 48 includes a locking pin 56 that may be inserted into the hole 50 of the rail 28, a housing 58 attached to the ladder mount 26 and having a wall 60, and a spring 62 to urge the locking pin 56 away from the wall 60. When the locking pin 56 is aligned with the hole 50, the spring 62 urges the locking pin 56 into the hole 50. Thus, when the ladder accessory 22 is moved in the up direction 42*a*, the rail 28 contacts the locking pin 56 to restrain movement of the ladder accessory 22 in the up direction 42*a*, Alternatively, a non-spring loaded catch may be used, such as a pin manually inserted into holes in the accessory and the rail that line up when the accessory is mounted.

Oval, Rectangular, and Butterfly Slots

FIG. 3 shows an embodiment where the rails have oval slots 37 along a centerline of the web and the accessories have L-hooks 39. The L-hooks each have an inner ledge 45 that presses against the web to restrain movement of the hook away from the web. The L-hooks are inserted into the slots and the accessory is slid along the rail so that the accessory is secured by the ledges on the hooks against movement in all directions but one, along the rail. A catchment device on the accessory, which may be a spring latch or may be a non-automatic catch, catches a catchment surface on the ladder to secure the accessory. The catchment surface may be one of the slots with no hook inserted, or it may be a slot into which a hook is inserted, such as the bottom-most slot in FIG. 3. After the hooks are slid into engagement, a portion of the bottom slot that was occupied as the hook was inserted is now available for use. A catch 47, as shown in FIG. 3, may be inserted into this empty portion of the slot, beside the base of the hook. In FIG. 3, the catch 47 is shown in inserted position, not in retracted position. The catch 47 may be a spring-loaded latch or it may be a manually actuated catch.

In the oval-slot system shown in FIG. 3, because the slots are symmetrical up and down, any accessory can be attached in either an up orientation or a down orientation, which is an advantage for accessories that have no single up or down orientation such as a transport wheel as shown in FIG. 1.

Described above are keyhole slots and oval slots. Other slot shapes are possible, particularly rectangular slots and butterfly slots 238 (oval slot with superimposed round hole of larger diameter than the width of the slot). Each slot needs to be at least wide enough across a width of the web to receive L-hooks or knobs of adequate thickness to have adequate strength. A preferred oval slot width is ⅜ to ½ inch. However, if the L-hooks are made of strong metal, the slots may be as narrow as $1/10^{th}$ inch. The preferred slot length is about 1 inch, which allows ½ inch of hook ledge 45 support length against the inner web surface 35 after ½ inch of sliding travel in the slot and leaves a ½ inch opening for a catch to be inserted. The minimal slot length is about ½ inch long with ¼ inch of sliding travel in the slot and ¼ inch of purchase by the ledge 45 against the web surface 35.

Whether the slots are oval shaped or keyhole shaped or butterfly shaped or rectangular, they can be distributed evenly along the ladder rail to allow an accessory to be attached anywhere or they can be place only in particular spots on the rail so that accessories will not be placed inappropriately. So that the rail retains adequate strength, the slots should not be placed no closer than about ½ inch from a rung attachment point or closer than about ½ inch from each other. It is preferred to place the slots at least 1 inch away from rung attachments and at least 1 inch away from each other. By selecting a stronger web material, the holes may be placed as close as ⅛ inch from a rung.

So that the accessory will be strong against rotation of a knob or L-hook in a slot, each accessory must engage at least two holes in the rail, either or both of which may be a slot. For this reason, each location on the rail where an accessory mount 24 is desired, there must be at least a pair of holes at a defined distance apart between 1 inch and 30 inches apart. The appropriate distance is controlled by the distance between structures on the accessory's ladder-mount 26 that engage the two holes of the pair. It is preferred that the holes in the pair are both between sequential rungs and therefore not more than about 10 inches center to center. In a preferred embodiment, there are 3 holes, the outer two holes forming the described pair at 9 inches center to center and an extra hole between them at 4½ inches center to center from each outer hole to provide additional strength.

Figure 4:
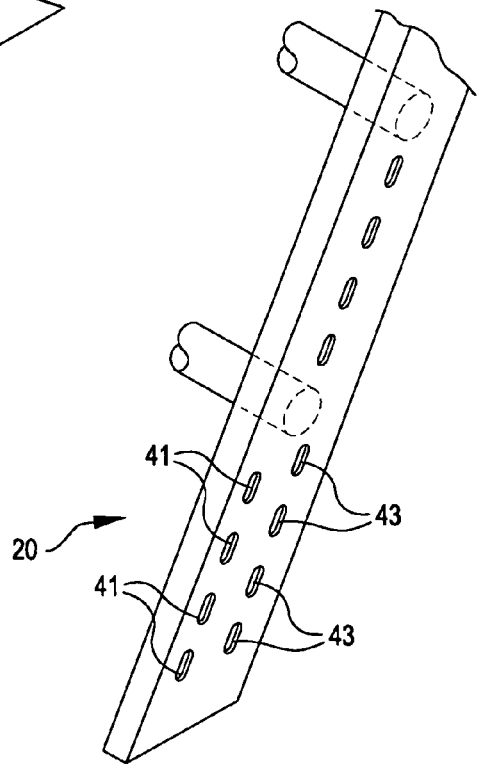
FIG. 4 shows side-by-side rows of pairs of slots.

Instead of one row of slots on the centerline of the web as shown in FIG. 3, there may be two rows of slots as shown in FIG. 4 where each slot is one of a side-by-side pair of slots that are even with each other across the width of the web. Each slot in a first row of slots 41 is opposite a slot in a second row of slots 43. The slots are preferably about ⅛ inch wide and about one inch long. The accessory has preferably four or more L-hooks that fit into the slots. The L hooks may be made at low cost and light weight by starting with a ⅛ inch thick sheet of metal, cutting it into a rectangle with L-hooks sticking off two opposite sides at locations symmetrical about a line on a centerline between the hooks, and then bending the metal 90 degrees at or near the base of each L-hook so the hooks now form pairs that are parallel to each other. The accessory is affixed to this sheet with four or more L-hooks.

Right Angle Pivoting into Engagement

Figure 5:
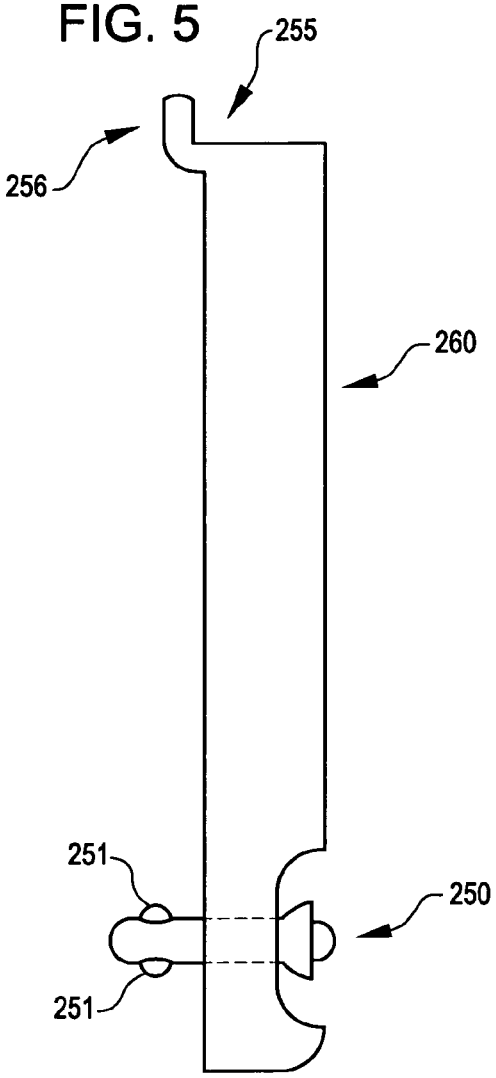
FIG. 5 shows a ladder-mount for an accessory where the ladder-mount includes one or two right angle hooks at one end or edge and an inserted pin type catch.

As shown in FIG. 5, instead of using slots and sliding the accessory along the rail to seat it, the rail may have a pattern of round (or square or any other shape) holes and the ladder-mount 260, 262 portion of an accessory may have one or two (or more) right-angle shaped hooks at one end or side of the accessory as shown in FIG. 5. With the accessory at 90 degrees from its final mounted orientation, the right-angle hook(s) 256 are inserted into a hole (which may be a slot) and the accessory is pivoted 90 degrees about a pivot axis parallel to the surface of the web until the accessory reaches its mounted position at which point the right-angle hook(s) hold one edge or end of the accessory snug against the web. As shown in FIG. 5, the pivot axis is formed by an inside right angle 255 of the right angle hook 256 that fits into a hole in the rail.

Figure 6:
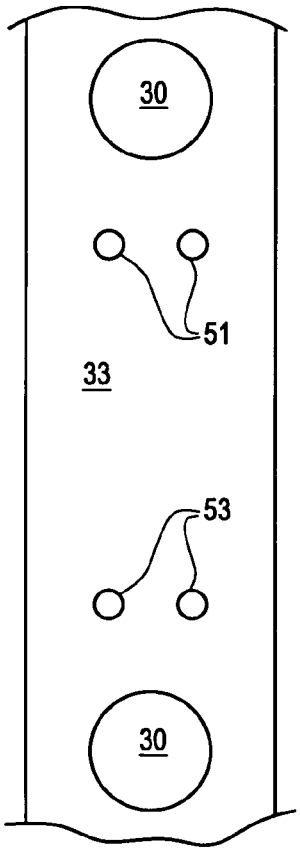
FIG. 6 is a side view of a ladder rail showing a pattern of four holes for attaching accessories.

For the system where accessories have a right-angle hook on one edge or end as shown in FIG. 5, a preferred pattern of holes in the ladder rail web is shown in FIG. 6. The accessories are designed with two right-angle hooks 256 and the two hooks are inserted into two holes 51 which form a pivot axis about which the accessory is pivoted until a pair of pins 250 in FIG. 5 slides into a second pair of holes 53 in the web. The pivot axis formed by the pair of holes 51 is across the web. Alternatively, by appropriate design of the accessory, the pivot axis may be along the web, in which case the two right-angle hooks are farther apart and they are inserted into one of the holes 51 and one of the holes 53.

Instead of two holes 51 side-by-side, there may be one hole that is rectangular or oval in shape to form the pivot axis. Alternatively, there may only be one round hole such that the accessory can pivot in all directions about the hole (rather than an axis) until the accessory is swung into locking engagement by at least one pin 250, 265 passing into at least one hole in the rail and catching the rail. The pin may be a fixed part of the accessory or it may be a removable part.

Catchments that retain the pin(s) 250 may be retractable nibs 251 as shown in FIG. 5. These nibs are a well known feature of locking pins. They are metal balls that are locked into protruding position by a spring loaded rod that passes through the center of pin 250. When a protruding button on the end of pin 250 is pushed, the balls are released to retract into the pin.

Rotation into Engagement

FIG. 7 shows a rail configured for accessories to be locked to the rail by rotation into engagement. A butterfly knob 240 fits into a butterfly hole 238 in a rail or in a mounting base affixed to the rail. The butterfly hole is an oval slot superimposed with a hole at its center which hole has a larger diameter than the width of the slot. When the butterfly knob is inserted into the butterfly hole and rotated a bit, all parts of the accessory are restrained against movement with respect to the ladder rail in all directions except rotationally in a curved or polar direction 254*a*-254*b* about an axis 220. The butterfly pin is inserted with the accessory at about 90 degrees from its final position and the accessory is then rotated into position. When a locking pin 132 is engaged, movement in the polar direction about the axis is restrained. The locking pin 132 may be replaced with a pin 250 having retractable nibs 251 as shown in FIG. 5 so the nibs can add strength against forces tending to separate the accessory 184 from the rail.

Channels on an Outer Rail Surface

Figure 9:
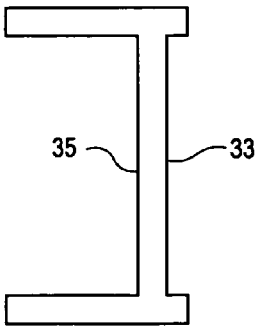
FIG. 9 (PRIOR ART)
FIG. 9 is a cross-section view of a prior art ladder rail.
Figure 10:
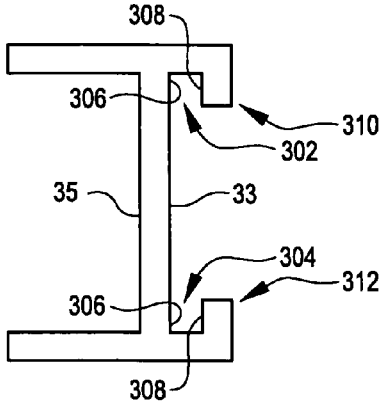
FIG. 10 is a cross-section view of a ladder rail with flanges added to form a pair of opposing channels to which accessories may be attached.

Instead of cutting holes in the ladder rail or mounting base, accessory attachment structures may be added to the rail or mounting base. An example is shown in FIGS. 10 and 12. FIG. 9 shows a cross section of a prior art ladder rail which is a beam with an inner web surface 35 and an outer web surface 33. In FIG. 10, flanges 310 and 312 have been added parallel to the outer web surface 33 to form channels 302 and 304 which are opposite each other and parallel to each other. Each channel is formed by a portion of the outer web surface 33 and a parallel surface of the flange 308. Essentially identical channels may be form in a mounting base that is affixed to the rail. The base may be made by extrusion, such as of metal or composite fiber and resin or thermoplastic polymer.

To securely engage the rail or base, an accessory is provided with a ladder-mount as shown in FIG. 11. The ladder-mount has two tabs or flanges 314 that fit into channel 308 and two flanges 316 that fit into channel 302. Each pair of flanges on the ladder-mount has a gap 318, 320 between the pair of flanges. The rail flanges 310, 312 also have gaps 322 shown in FIG. 12, each gap at least as wide as a ladder-mount flange so that the ladder-mount flanges can pass through the rail flange gaps 322 to allow the ladder-mount flanges to slide into the channels. As the flanges 310 and 312 are added to the parts of the rail beam that are most in tension or compression, they add significant strength to the rail. Consequently, the gaps 322 are not cut in the parts of the rail most likely to fail which are parts near the rung attachments 30.

Where the flanges 310 and 312 are a part of an attachment base affixed to the ladder rail, it is unnecessary to cut away gaps 322 and it is unnecessary to include gaps 318 in the ladder-mount because the accessory flanges 314, 316 can be slid in the attachment base at an end of the attachment base.

Once the ladder-mount flanges are slid into the channels, the accessory is locked in place with a catch that catches a catchment surface on the rail that is perpendicular to the length of the rail. The catchment surface may be a hole in the rail 326 or it may be an edge 324 of the gap 322 in the rail flange 310, 312. The catch may be a spring latch or a non-automatic catch.

Metal or Fiber Composite Ladders

Ladders that are adapted as described above for attaching accessories may be made of metal, such as extruded 6063-T52 aluminum, or fiber-resin composite such as fiberglass used for ladders. The holes, slots, and flanges described above may be applied to either material. However, for fiber composite materials, it is sometime preferred to carry a part of the load of an accessory on a metal plate attached to the web such as with rivets. In this case, the holes or slots are formed in both the web of composite material and in the attached plate.

Bolt-On Accessory Mounting Base

Instead of being placed directly in the web of the ladder rail, the accessory attachment structures described above may be placed in a separate piece of material that is bolted or riveted to the rail. An example of such a bolt-on accessory attachment mounting base 80 is shown in FIG. 13. The dimensions should be at least one inch by six inches to insure adequate rigidity in its connection to the ladder rail and to the accessory, preferably at least 1 inch by 8 inches. In one embodiment, the dimensions of the attachment base are one and one-half inch by 12 inches. The attachment base need be only as thick as necessary to perform all of its functions, including spacing a leveler out from the side of the rail to clear a foot on the bottom end of the rail. A preferred embodiment is made of 6063-T52 aluminum rectangular tubing with one-eighth inch wall thickness.

As shown in FIGS. 13 and 14, the attachment base may be made in box beam shape for strength, at least 6 inches in length, hollow inside, with four side walls, each at least 1/10 inch thick, a first side and an opposite second side each being at least 1 inch in width. One adds holes in the first side of the box-beam through which the base is affixed to the ladder rail, and holes in the second side of the box-beam through which an accessory may be attached. It is preferable for the holes on the first side to be opposite holes on the second side for ease of attaching the base to the ladder.

The box-beam may be made of metal or it may be made of composite fiber and cured resin or of thermoplastic polymer. It is preferably extruded but it may be made by other methods such as cutting, bending and welding a plate of metal. If made by extrusion, it is attractive for the structures for attachment to comprise a pair of opposing channels into which tabs on the attachment may be slid as described above and shown in FIGS. 11 and 12, with or without gaps through which tabs may pass to enter the channels.

The accessory mounting base may be made by molding, with molded structures on a side of the molded material to which an accessory may be attached. The structures may be any of those described above. The base may be molded of thermo-plastic polymer, with or without added fibers for strength; it may be molded of composite fiber and resin; and it may be molded of metal.

Alternative Catches

The hand-releasable catch may be placed on the ladder rail or bolt-on accessory mounting base or on the accessory. FIG. 13 shows an example where the catch is a spring 90 loaded latch 86 on a bolt-on accessory mounting base 80. The latch pivots about an axis parallel to the web surface and perpendicular to the web length, the axis formed by a hinge pin 96. As shown in FIG. 14, the latch 86 catches the knob 84 on one side 88 of the knob to restrain sliding movement of the knob.

Figure 15:
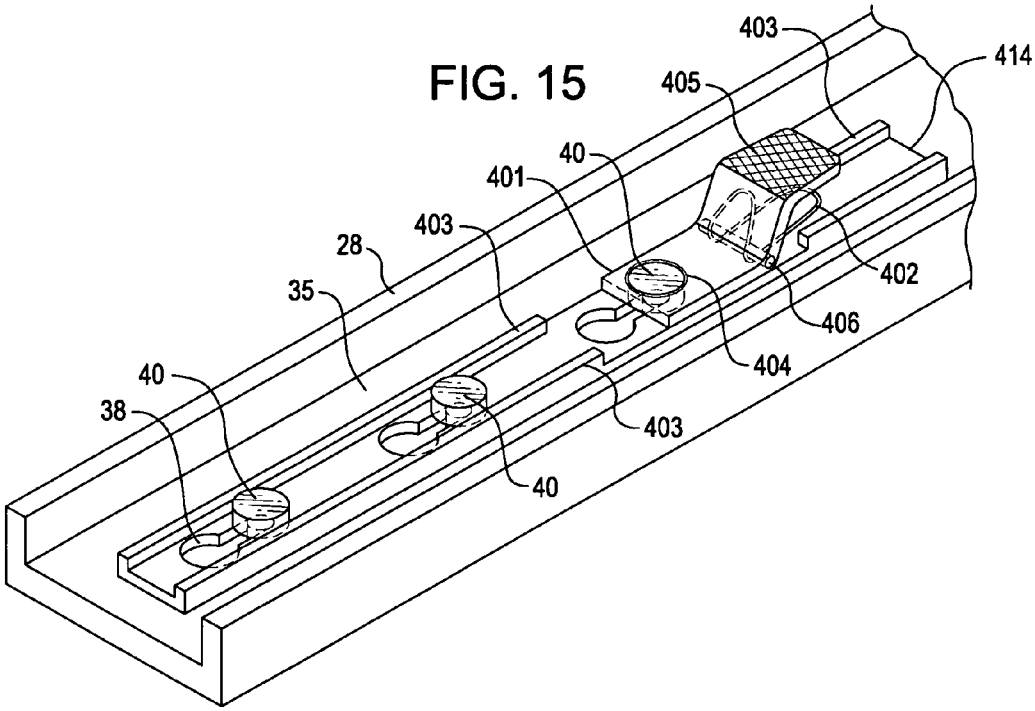
FIG. 15 is an oblique view of the inside of a ladder rail with an affixed catch in the form of a spring loaded latch.
Figure 16:
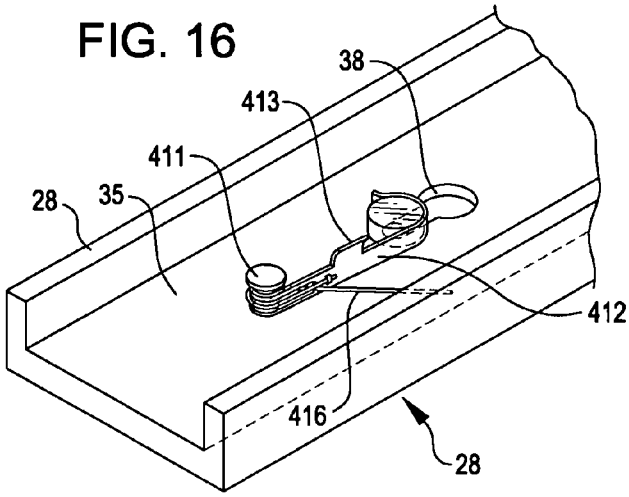
FIG. 16 shows an alternative latch that pivots to one side instead of away from the web.

FIG. 15 shows a similar hinged spring latch 401 modified to mount on the inside face 35 of a ladder rail 28. The latch 401 includes a hole 404 to capture the knob and carry its force over a semi-circle contact area and a large pedal 405 for easy finger actuation. The latch pivots on a hinge pin 406 and is urged into place by a torsion spring 402. The latch is attached to a piece of extruded metal 414 added to the inside face 35 of the ladder rail 28. The extruded metal 414 includes guide lips 403 that keep the knobs from flopping to one side, which facilitates removal of the knobs from the slots.

The latch of FIG. 15 can be modified to be made of one piece spring steel, eliminating the hinge pin and torsion spring. A portion can be bent to form a pivot so that one pushes in, like in FIG. 15 to release the knob, or it can be designed with rivet points on one side of the knob and bent to form a handle on the other side of the knob so that one pulls out to release the knob.

One may form a spring latch that is pulled out, away from the inner surface 35 of the rail 28, using a finger-pull ring.

FIG. 5 shows a ladder mount 260 of an accessory (not shown) with a right-angle hook 256. It has at least one pin 250 that fits into a hole (or pair of holes) such as holes 53 in FIG. 6. A recess in the side of the pin can be caught by a catchment surface of a catch which is slid along the inner surface 35 of the rail. The catch includes a keyhole slot so that the pin is retained when the catch is slid in one direction and released when the catch is slid in another direction. In one embodiment, the catch has two key hole slots side by side to retain two pins 250 simultaneously.

Figure 17:
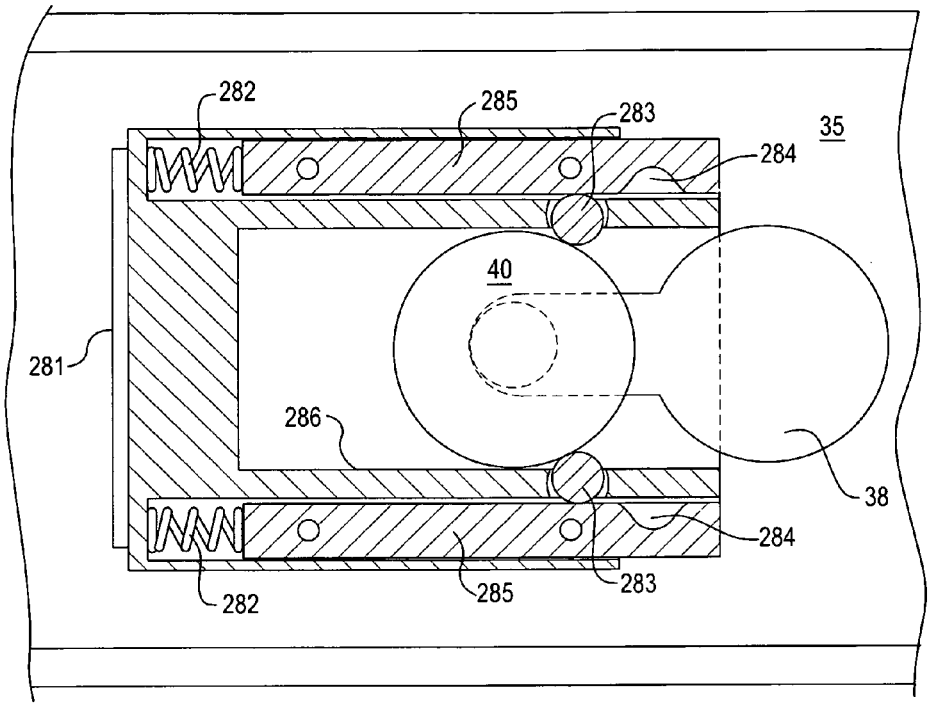
FIGS. 17 and 18 shows an alternative latch that is slid parallel to the surface of the web to allow a knob on a pin to be slid in an opposite direction for release.
Figure 18:
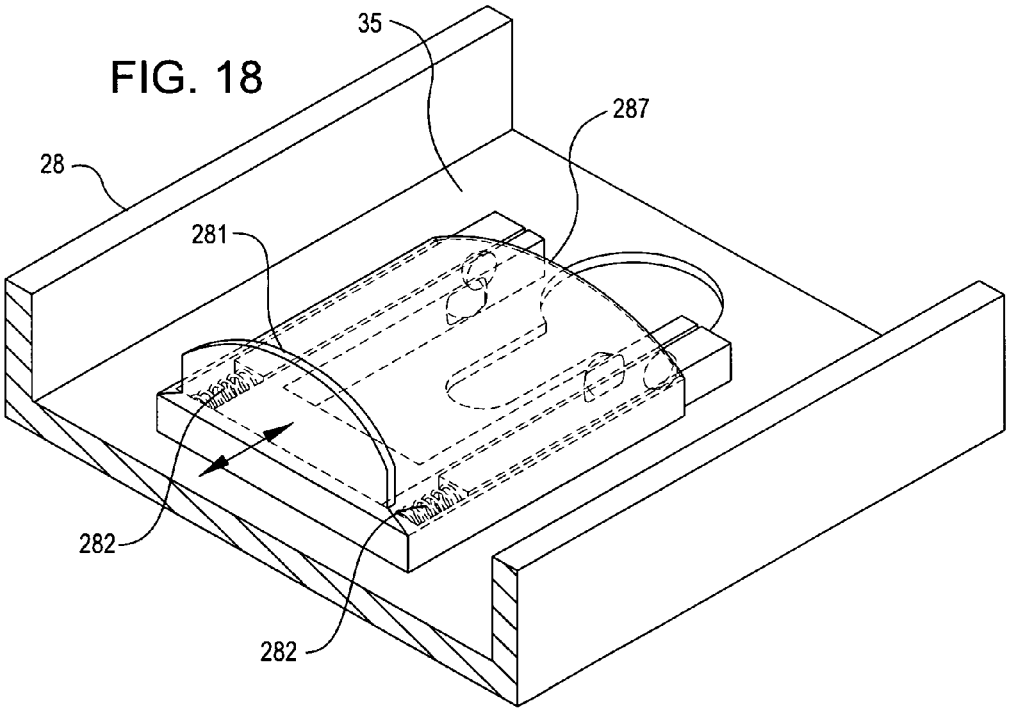

FIGS. 17 and 18 show a catch that must be pulled to mount the accessory and pulled again to release the accessory. A tab 281 is coupled to two parallel arms 285, one extending on either side of a piece 286 affixed to the web 35 and on each side of the keyhole 38. The tab and arms are held against a stop (not shown) by one or two springs 282. On the keyhole side of each arm 285 is an indentation 284. Into each indentation, when the tab is pulled to compress the springs, a ball bearing 283 may be pushed by the knob (or fall by gravity) to allow the knob to pass and be released. In FIG. 21, the latch assembly is covered with a cover 287.

Although the present invention has been described in considerable detail with reference to certain embodiments, other embodiments are possible. Therefore, the spirit or scope of the appended claims should not be limited to the description of the embodiments contained herein. It is intended that the invention resides in the claims hereinafter appended.

What is claimed:

1. A system of a ladder having slots in rails, usable for attaching accessories by inserting accessory attachment structures into the slots, and an accessory for attaching to the ladder, comprising:

a. a ladder accessory having at least one pair of accessory attachment structures that may be inserted into at least one pair slots;

b. a ladder comprising two rails connected by rungs, each rail comprising a web that is part of a beam with two parallel flanges, one flange on each side of the web, the web defining a longitudinal centerline, with a plurality of rungs attached along the centerline of the web, c. a plurality of pairs slots in the web of each rail, each slot disposed on the centerline and no closer than ⅛ inch to a rung attachment, each pair of slots in each rail being within a single between-adjacent rungs section of the web and the slots in each pair being no closer than ½ inch apart, each slot being at least 1/10 inch wide across the width of the web and at least ½ inch long along the length of the web, d. each rail including a catchment surface proximate each pair of slots, the catchment surface effective to retain at least one accessory attachment structure of the pair of accessory attachment structures when they are inserted into the at least one pair of slots, and e. each rail having affixed to an inside face of the rail, alongside the slots, a pair of guide surfaces, one guide surface on each of two sides of each slot, that restrain movement of inserted accessory structures and thereby facilitate attachment or removal of the accessory attachment structures, wherein each rail includes a metal plate affixed to the web, the plate having at least one slot aligned directly over at least one slot in the web, wherein said catchment surface and said guide surfaces being part of the metal plate; wherein each accessory structure comprises of a pin having a knob; and each slot is formed so that, after insertion into a slot each pin slides along a length of the slot until the knob slides over a portion of the catchment surface adjoining the slot, and a catch is disposed to retain each pin with its knob over the portion of the catchment surface, wherein the catch comprises a hinged spring biased latch hinged to the metal plate and having a round hole that, when engaged, surrounds and retains the knob.

2. The ladder and accessory system of claim 1 wherein each slot in the pair is keyhole shaped.

3. The ladder and accessory system of claim 1 wherein each slot in the pair is quadrilateral in shape.

4. The ladder and accessory system of claim 3 wherein each slot in the pair is rectangular in shape.

5. The ladder and accessory system of claim 1 wherein the catch is automatically activated.

6. The ladder and accessory system of claim 1 wherein the catch is manually activated.

7. The ladder and accessory system of claim 1 wherein the ladder is an extension ladder.

8. The ladder and accessory system of claim 1 wherein each slot is at least ⅜ inch wide, and no closer than ½ inch to a rung attachment.

9. The ladder and accessory system of claim 1 wherein each rail of the ladder is made of composite fibers and cured resin comprising the web that is part of the rail.

10. The ladder and accessory system of claim 1 wherein each rail of the ladder is made of extruded aluminum comprising the web that is part of the rail.

* * * * *